United States Patent [19]

Hirschfeld

[11] Patent Number: 4,678,142

[45] Date of Patent: Jul. 7, 1987

[54] PRECISION GUIDED ANTIAIRCRAFT MUNITION

[75] Inventor: Tomas B. Hirschfeld, Livermore, Calif.

[73] Assignee: The United States of America as represented by the Secretary of the Air Force, Washington, D.C.

[21] Appl. No.: 758,927

[22] Filed: Jul. 25, 1985

[51] Int. Cl.[4] ..... F42B 15/027

[52] U.S. Cl. ..... 244/3.16

[58] Field of Search ..... 244/3.16

[56] References Cited

U.S. PATENT DOCUMENTS

| | | | |
|---|---|---|---|
| 3,695,555 | 10/1972 | Chadwick | 244/3.16 |
| 3,743,216 | 7/1973 | Salonimer | 244/3.16 |
| 3,841,585 | 10/1974 | Evers-Euterneck | 244/3.15 |
| 3,872,308 | 3/1975 | Hopson et al. | 250/347 |
| 4,105,174 | 8/1978 | Blomqvist et al. | 244/3.16 |
| 4,143,835 | 3/1979 | Jennings, Jr. et al. | 244/3.16 |
| 4,153,224 | 5/1979 | Rampolla et al. | 244/3.16 |
| 4,168,813 | 9/1979 | Pinson et al. | 244/3.16 |
| 4,213,394 | 7/1980 | Brenner | 102/213 |
| 4,373,688 | 2/1983 | Topliffe | 244/3.24 |
| 4,381,090 | 4/1983 | Garner | 244/3.16 |
| 4,438,893 | 3/1984 | Sands et al. | 244/3.21 |
| 4,565,340 | 1/1986 | Bains | 244/3.28 |

*Primary Examiner*—Charles T. Jordan

*Attorney, Agent, or Firm*—Stanton E. Collier; Donald J. Singer

[57] ABSTRACT

A small diameter, 20 mm to 50 mm, guided projectile is used in antiaircraft defense. A pulsing laser designator illuminates the target aircraft. Energy reflected from the aircraft is received by the guided projectile. The guided projectile is fired from a standard weapon but the spining caused by the riflings are removed before active tracking and guidance occurs. The received energy is focused by immersion optics onto a bridge cell. AC coupling and gating removes background and allows steering singls to move extended vanes by means of piezoelectric actuators in the rear of the guided projectile.

1 Claim, 3 Drawing Figures

PRECISION GUIDED ANTIAIRCRAFT MUNITION

STATEMENT OF GOVERNMENT INTEREST

The invention described herein may be manufactured and used by or for the Government for governmental purposes without the payment of any royalty thereon.

BACKGROUND OF THE INVENTION

This invention relates generally to antiaircraft munitions and, in particular, relates to guided antiaircraft munitions.

In the past, several types of munitions have been used in point defense against aircraft attack. One type is the shoulder fired guided missile which is either guided by a laser designator or a trailing wire. Although this weapon may be effective for its intended purpose, it lacks a high fire rate because each round must be loaded individually in the shoulder launcher. Another type of point defense is the radar directed gun such as the DIVAD. The disadvantages are its high cost and a very high rate of fire needed to put up a wall of "lead" to insure a kill with the smaller caliber munition used.

SUMMARY OF THE INVENTION

The present inventon sets forth a guided projectile fired from a gun having a bore of about 20 to 50 mm.

The present invention uses a conventional small caliber antiaircraft gun. The rounds therein have a typical metal cartridge with a conventional propellant onto which the guided projectile is fitted. In addition to the above, the present invention uses a pulsing target laser designator for illuminating the intended aircraft target.

Within a fraction of a second or so after leaving the gun muzzle, derotating and steering vanes are deployed from the projectile, for example, which cause the projectile to stop rotating within a few seconds. After the projectile has stopped spinning, a laser guidance system steers the projectile to the target.

An immersion optical lens in the front of the projectile focuses the received laser radiation onto a bridge cell positioned directly behind the lens. Depending upon the position of a focused spot on the cell, appropriate drive signals will actuate the steering vanes to maneuver the projectile to the target or near the target for detonation.

It is therefore one object of the present invention to provide a guided projectile for a small diameter round usable in a conventional weapon.

Another object of the present invention is to provide better point defense against aircraft with a round that is more likely to hit the target.

Another object of the present invention is a guided projectile that has a lower minimum range, has a greater chance of survival against counter measures, has a higher fire rate, and has a lower launch signature.

These and many other objects and advantages of the present invention will be readily apparent to one skilled in the pertinent art from the following detailed description of a preferred embodiment of the invention and the related drawings.

DETAILED DESCRIPTION OF THE PREFERRED EMBODIMENT

Figure 1:
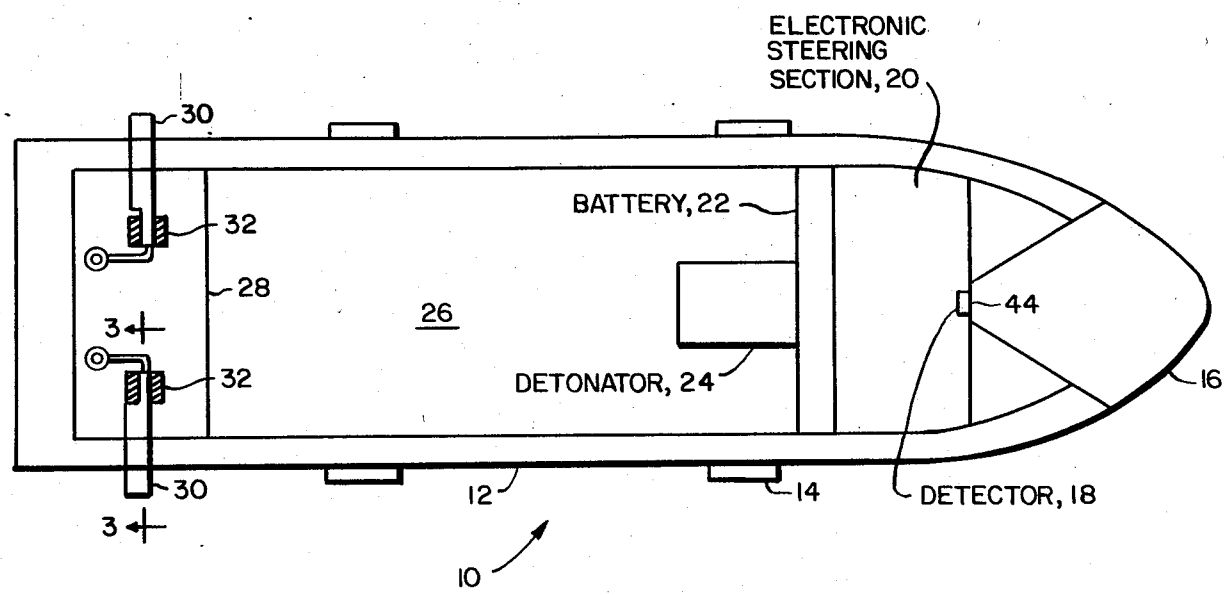
FIG. 1 is a cross section view of a guided projectile of this invention.

Referring to FIG. 1, a guided projectile 10 is shown in cross section. The diameter of projectile 10 ranges from 20 mm to about 50 mm and is used in a conventional weapon, not shown. In addition, a conventional laser designator, also not shown, is used by the weapon crew to select a target aircraft. The aiming of the laser designator can be by radar or optical tracker.

Projectile 10 has a casing 12 with rotating lands 14 about casing 12. An immersion lens 16 is mounted in the nose of projectile 10 and causes received laser radiation to be focused onto a quadrant detector 18 being a bridge cell tracker. Detector 18 is connected into an electronic steering section 20. Power is provided by a battery 22 activated by firing. A detonator 24 causes high energy explosive 26 to detonate upon impact. A vane control section 28 is placed at the rear of projectile 10. Vanes 30, two shown of four, are used to derotate projectile 10 and to steer projectile 10 to the target aircraft.

Because projectile 10 is fired from a weapon having riflings, the rotation must be stopped before active guidance can be started. This may be achieved several ways. A rotating sabot may be placed about projectile 10 to minimize the spin imparted by the riflings. The sabot would then drop away after projectile 10 clears the muzzle of the weapon or rotating lands 14 may be used. In either case, projectile 10 would still have some spin upon leaving the muzzle. Very shortly after leaving the muzzle, vanes 30 would be automatically deployed by springs 32 into a position to maximize derotation at which time a derotation switch 34, FIG. 2, allows a detector 36 to output signals 46, 48 and 50.

Figure 3:
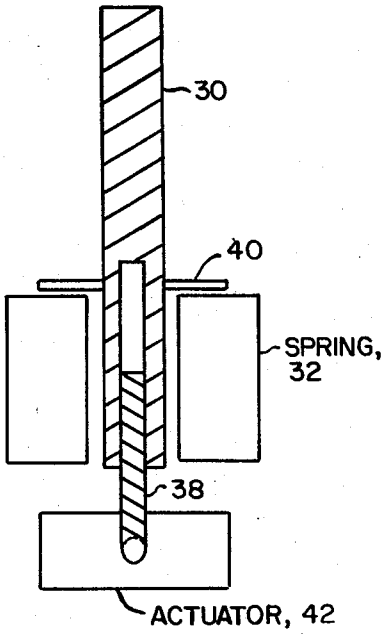
FIG. 3 is a cross secton of a steering vane of the present invention.

Referring to FIG. 3, vane 30 is shown in the extended position. Initially vane 30 is depressed onto an arm 38 being box shaped to prevent rotation of vane 30 about arm 38. After leaving the weapon muzzle, vane 38 is extended by spring 32 acting against a retainer 40 attached to vane 30. Arm 38 is attached to an actuator 42 that can turn either one vane or two vanes 30. Vanes 30 can be held in place by the sabot, not shown or by other such means, that breaks away upon leaving the muzzle whereupon vanes 30 are extended.

Actuator 42 is an electromechanical device that provides motion piezoelectrically. Actuator 42 is a multiple ring actuator in which the actuator shaft is driven through a mounting by repeated peristatic strokes. The stroke length is unlimited and the steps are as rapid as pulses can be applied.

Referring to FIG. 1, immersion lens 16 is connected directly to a bridge cell 44. Table I provides typical parameters.

TABLE I

| | |
|---|---|
| Laser type | |
| Operating wavelength | 10650 A |
| Operating mode | Repetitive Q-switch |
| Laser pulse energy | 1 V |
| Pulse length | 15 nanosec |
| Laser beam divergence | 0.2 mrad |
| Beam spreader transmission | 90 |
| Photons per pulse | $5.36 \times 10^{18}$ |
| Pulse repetition rate | 30 $sec^{-1}$ |
| Range of laser to spot | 5000 m |
| Target hemispherical reflectance | 15 |

TABLE I-continued

| | |
|---|---|
| Range of detector to spot | 1500 m |
| Atmospheric condition | Standard Clear |
| Height of path worst case | −0 |
| Atmospheric attenuation coefficient | 0.115 $Km^{-1}$ |
| Total atmospheric transmission | 47.4 |
| Collector diameter | 1.6 cm |
| Collector field of view | 30° |
| Detector diameter | 4.0 mm |
| Immersion material | Sapphire |
| Immersion material index | 1.76 |
| Beam convergence at detector | 72° |
| Required angular resolution | 10 mrad |
| Required lens resolution | 13.1 p/mm |
| Filter band width | 300 A |
| Filter transmission | 75 |
| Transmission of optics | 80 |
| Total transmission | 60 |
| Band width of AC system | 25 MHz |
| Time constant of detector | $10^{-7}$ sec |
| Detector noise, 1 Hz bandwidth | $4.0 \times 10^{-13}$ W |
| Detector noise, operating bandwidth | $5 \times 10^{-9}$ W |
| Detector quantum efficiency | 75 |

Bridge cell 44 is a single photodiode having four independent anodes or quadrants. The ratio of the quadrant output defines the location of the focused spot on cell 44.

Figure 2:
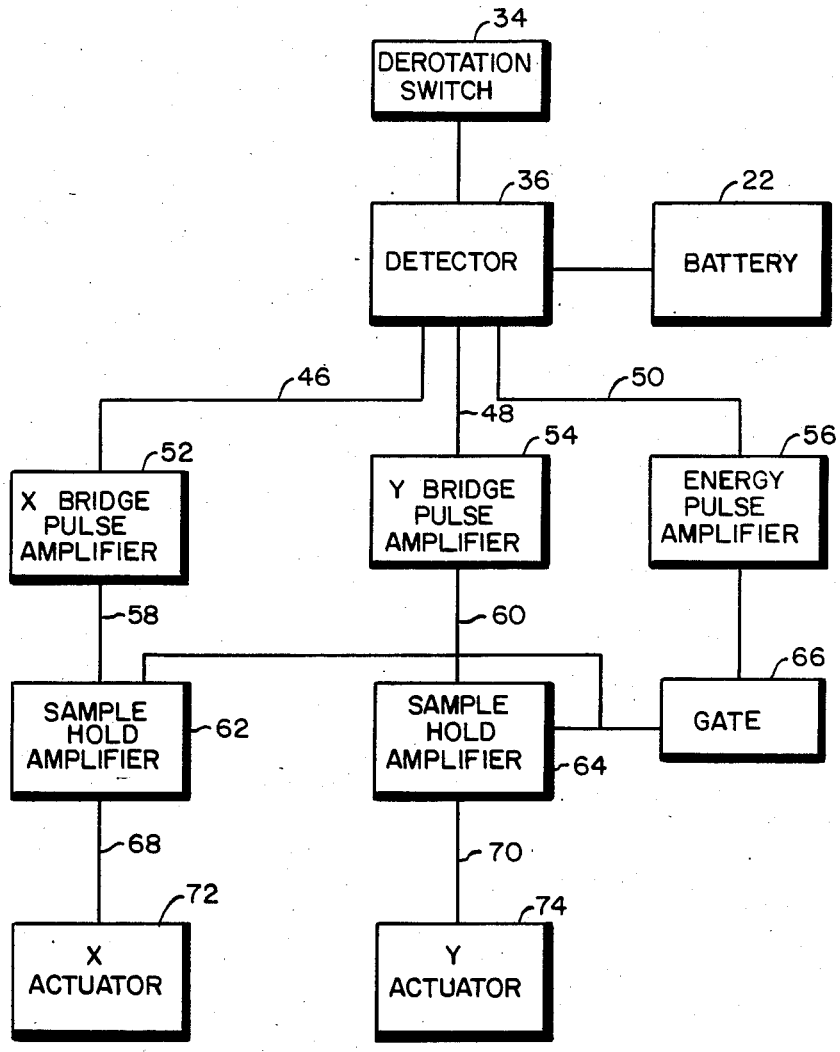
FIG. 2 is a functional block diagram of the electronics for steering the guided projectile.

Referring to FIG. 2, when X output 46, Y output 48, and I (energy pulse) output 50 of bridge cell 36 are AC coupled to amplifiers 52, 54 and 56, the outputs correspond to that part of the image which changed within one time constant. In $10^{-7}$ sec the background is effectively stationary, and produces no signal. Thus any variation in the outputs is produced solely by the laser spot, the only part of the input that varies fast enough. This circumvents the tendency of the bridge cell of detecting the centroid of all sources present instead of the one source one is interested in.

Whenever an I output 50 is sensed, the X and Y amplified outputs 58 and 60 are gated by gate control 66. As the guidance becomes more and more accurate, X and Y become smaller as they are measures of the deviation from the "true" direction. When projectile 10 is on a perfect track, there will be no X and Y outputs 46 and 48 when I output 50 is detected, and no tracking inputs 68 and 70. As the electronic steering is a nulling one, the values of X and Y, the amplifier gain, and the guidance responsivity require only gross estimation, not calibration. As the system senses angular deviation, it becomes better the closer its gets to the spot, and so can be aligned quite permissively.

The size of the laser spot is not critical as the centroid will be detected. However, at very close ranges the spatial reflectivity variation within the spot will shift its centroid. Fortunately, this happens at only very close ranges where small angular errors are insignificant.

The maximum range equation for projectile 10 assuming no atmospheric loss and a target approaching along the line of sight is $$R_M = \frac{1}{a}\,\mathrm{Ln}\left[1 + av_o\left(t_D + R_A\frac{aL_D}{\alpha T}\right)\right] + v_T\left[\Delta t + R_A\sqrt{\frac{aL_D}{\alpha T}}\right] \quad (1)$$

where $R_M$=maximum range $R_A$=average range a=air drag velocity loss factor $v_o$=initial velocity $t_D$=lag time for target maneuver acceleration $L_D$=lift drag ratio $\alpha_T$=maximum target maneuver acceleration $v_t$=target velocity Here we have for the range at intercept $$R_I = \frac{1}{a}\,\mathrm{Ln}\left[1 + av_o\left(t_D + R_A\sqrt{\frac{aL_D}{\alpha T}}\right)\right] \quad (2)$$

the time at intercept $$t_M = t_D + R_A\sqrt{\frac{aL_D}{\alpha T}} \quad (3)$$

the velocity at this point $$v = \frac{v_o}{lta\ v_o t_M} \quad (4)$$

and the maneuvering capacity here is $$\alpha_M = a\,L_D v^2 \quad (5)$$

The time duration of the guidance phase is $$t = \frac{v_t v_T}{av^2}\left(\sqrt{1 + 2R_A\frac{av^2}{v + v_T^2}} - 1\right) \quad (6)$$

Clearly, many modifications and variations of the present invention are possible in light of the above teachings and it is therefore understood, that within the inventive scope of the inventive concept, the invention may be practiced otherwise than specifically claimed.

What is claimed is:

1. A guided projectile for use in an antiaircraft gun, a target aircraft being illuminated by a pulsing laser designator for said guided projectile to home upon, said guided projectile comprising:

a casing, said casing being aerodynamically shaped;

means for derotating and steering said guided projectile, said means attached to a rear section of said casing, said means including a plurality of steerable deployable vanes, said vanes being positioned in said rear section of said casing, said vanes causing said projectile to change from spin stabilized to drag stabilized;

optical means for focusing reflected laser radiation from said aircraft onto a designated area, a position of a spot, being the focused reflected laser radiation, on said designated area corresponding to a position of said aircraft in a field of view, said optical means being positioned at a front of said casing;

an electronic steering section, said electronic steering section outputting signals for controlling said vanes for derotating and steering said guided projectile, said signals being a function of said position of said spot on said designated area, said electronic section outputting signals to null said signals, said electronic steering section including a bridge cell having four detector quadrants forming said designated area, said bridge cell coupled to said optical means;

a vane control section, said vane control section receiving said signals from said electronic steering section, said vanes being driven by piezoelectric actuators that receive said signals;

a high energy exposive, said explosive positioned within said casing;

a detonator, said detonator causing said explosive to ignite upon predetermined conditions; and a battery, said battery being activated upon the firing of said guided projectile, said battery providing power to said electronic steering section and said vane control section.

* * * * *